US005520486A

United States Patent [19]

Van Wyck

[11] Patent Number: 5,520,486

[45] Date of Patent: May 28, 1996

[54] DIVER SAFETY APPARATUS AND METHOD

[76] Inventor: William Van Wyck, 1 Sunrise Rd., Westport, Conn. 06880

[21] Appl. No.: 303,390

[22] Filed: Sep. 9, 1994

[51] Int. Cl.[6] ..... B63C 9/00; G08B 5/40

[52] U.S. Cl. ..... 405/186; 116/210; 116/214; 441/12; 441/13; 441/30

[58] Field of Search ..... 405/186, 185; 116/209, 210, 214, DIG. 8, DIG. 9; 441/6, 11–13, 16, 30

[56] References Cited

U.S. PATENT DOCUMENTS

| | | | |
|---|---|---|---|
| 2,825,803 | 3/1958 | Newbrough | 116/210 X |
| 2,842,090 | 4/1958 | Samwald | 116/210 |
| 3,667,417 | 6/1972 | Clinkenbeard | 441/30 X |
| 3,759,216 | 9/1973 | Sanders et al. | 116/210 |
| 3,898,609 | 8/1975 | Charles | 441/19 X |
| 3,902,327 | 9/1975 | Guillerm | 405/186 |
| 3,977,031 | 8/1976 | Saunders | 116/210 X |
| 4,464,129 | 8/1984 | Vancheri et al. | 441/16 |
| 4,475,476 | 10/1984 | Howard | 116/210 |
| 4,586,456 | 5/1986 | Forward | 116/210 |
| 4,932,910 | 6/1990 | Hayday | 441/12 X |
| 5,020,467 | 6/1991 | Van Patten et al. | 116/210 |
| 5,141,458 | 8/1992 | Church | 441/30 X |
| 5,406,294 | 4/1995 | Silvey et al. | 441/30 X |

FOREIGN PATENT DOCUMENTS

| | | | |
|---|---|---|---|
| 2275027 | 8/1994 | United Kingdom | 441/30 |
| 8301425 | 4/1983 | WIPO | 441/11 |

*Primary Examiner*—Ramon S. Britts
*Assistant Examiner*—Frederick L. Lagman
*Attorney, Agent, or Firm*—Adam L. Brookman; Godfrey & Kahn

[57] ABSTRACT

The present invention comprises a method and apparatus for identifying a down diver in distress comprising activating automatic inflation means to inflate a tube, activating automatic signal means, to provide sensory indication of a diver in distress, releasing the tube and the signal means away from a diver's body, allowing the tube and the signal means to float to the surface of the water and signalling for help with the signal means.

24 Claims, 4 Drawing Sheets

DIVER SAFETY APPARATUS AND METHOD

FIELD OF THE INVENTION

The present invention relates generally to devices and methods for use in diving, and more particularly to such devices which can be used to enhance a diver's safety.

BACKGROUND OF THE INVENTION

The technology of diving has improved dramatically since the days when divers walked the floor of the ocean with lead boots and a thick hose attached to a surface vessel. Today, the technology of choice for most divers, recreational and professional, is SCUBA (Self Contained Underwater Breathing Apparatus). While this technology has given divers increased mobility and more overall freedom, it has brought with it at least one significant problem; limited air supply.

While SCUBA divers are taught to scrupulously monitor their air usage and to surface immediately at the first sign of trouble this is often not enough. For example, if a diver becomes entangled in vegetation he may not be able to surface when his air supply is running out. This is compounded when the diver is far below surface and a decompression period is necessary to avoid potential decompression sickness (the bends) or an air embolism.

Efforts to avoid such out of air situations has led to the development of so-called secondary or redundant air supplies. These expensive devices provide a diver with a limited back-up supply of air sufficient to provide a number of extra breaths depending upon the depth. This is generally enough air to allow a diver to get to the surface from that depth using emergency ascendancy techniques (i.e., risk the bends, but don't drown). However, if a diver is entrapped, or otherwise incapacitated, an extra air supply is of limited value.

The only way to cope with entrapment or incapacitation situations is to secure assistance from another diver. That is why standard SCUBA diving procedure calls for every diver to have a "buddy." It is the buddy's job to keep track of his partner, to extricate him from entrapment, to share air with his partner if the partner runs out and to seek help if he is unable to provide sufficient assistance to his partner. Unfortunately, the buddy system is not perfect. In 1992, the Divers Alert Network ("DAN") reported that 17 percent of the divers in its database had an air problem, with 87 percent of those divers experiencing Type II Decompression Sickness, a mild form of the bends. DAN also reported that 96 divers died in 1992, 62 by drowning, with 34 of those due to out of air conditions.

The buddy system is imperfect for a number of reasons. First, if the buddy must go to the surface to seek help, he must surface slowly, spending time to decompress or he could be in trouble as well. Moreover, once the buddy has reached the surface, he can easily lose track of the down diver geographically, especially if a diving boat or platform is some distance from the point at which he surfaces. Still further, if the two divers are alone, the diver who has gone to the surface is usually not in a position to descend again to rescue the down diver. If the diving is being done in water with low visibility, it is very easy to lose a buddy. In such situations there is no way for the buddy to know his partner is in trouble until he has surfaced and his partner does not. At that point, the buddy will generally be unable to locate the down diver. Even if he can locate him, it will likely be too late.

Moreover, if a diver is in a distressed position and a buddy is attempting to assist him, there is no way for the rescuer to alert others of the situation. If a diver is in an out of air position and a buddy is attempting a rescue, it is standard procedure to raise the victim to the surface and drag him to safety (e.g., shore or a boat) so CPR can be performed. This is an extremely critical time for the victim. It can take as little as five minutes without air for permanent brain damage to occur. Every additional minute can make the difference between life and death. If a rescuer could notify the surface the instant he becomes aware of a problem, many lives could be saved.

A number of devices have been proposed which could conceivably be used to assist in the above-described situations. For example, U.S. Pat. No. 3,105,459 discloses a device which comprises a buoyant body having an integrated collapsible flagstaff. The body, which is unwieldy because of its inherently buoyant nature, is attached to the diver's gear and is supposed to be released when the diver is ready to ascend. The avowed purpose of the device is to warn those on the surface that a diver is surfacing to avoid having a boat run the diver down.

The use of buoyant flags to indicate the presence of divers is a common practice. In fact, in some states, such as Rhode Island, this practice is prescribed by a law which mandates that boats keep from getting within a set distance of such a flag and that divers actually tow the flag with them. Thus, the use of such flags will not indicate that a diver is in trouble below the surface—in fact, quite the contrary. Since there is no universal diver distress flag or codes, even the employment of a uniquely patterned flag will be ineffective. Moreover, the use of a non-luminescent, solely visual signal does no good if a potential rescuer is not looking directly at it or for it or if the incident occurs at night.

U.S. Pat. No. 3,760,440 discloses a device which is designed to permit a diver to communicate with the surface by the use of different colored air bags. Deflated air bags are carried down by a diver in a capsule which has a mouthpiece to enable the diver to inflate selected colored air bags. This device is not designed to identify a diver in trouble and provides only a non-luminescent, visual signal. Moreover, it requires that the diver use his own air supply to inflate the air bag. This would be unacceptable in a panic situation and impossible in an out of air situation.

U.S. Pat. No. 3,798,629 discloses an alarm system for divers which is designed to automatically operate when a diver's breathing cycle is compromised. The alarm device consists of an electronic circuit to detect a diver's breathing cycle coupled to a releasable alarm unit comprising a "sparkler" to inflate an attached balloon and an optional depth indicator and/or dye ampule. The alarm can be manually released.

This device requires complicated circuitry and a direct connection to a divers breathing apparatus. For much of its operation, it relies on springs and strings—components which are too unreliable in an emergency device designed to function in salt water. It also must be securely attached to a diver's body such that it can interact with a diver's breathing apparatus and may be unreachable in an entrapment situation. Further, the balloon is a non-luminescent, non-standard, visual signal which would not be seen at night, in choppy seas or in fog as it does not include any audible or luminescent signal capability. Even if seen, it would not be recognized at the surface as a distress signal by the uninformed.

SUMMARY OF THE INVENTION

It is an object of the present invention to provide an improved diver alarm system and method.

It is another object of the present invention to provide a more simplistic diver alarm system which provides either an audible or luminescent signal or both.

It is yet another object of the present invention to provide an improved diver alarm system which is inexpensive and simple to manufacture.

One preferred embodiment of the present invention comprises a housing, a cap releasably attached to the housing, a core located inside the housing and sealing means for sealing the core within the housing. The core comprises an inflatable tube, inflation means for inflating the tube with a gas, a siren (horn) assembly and a power supply.

In another embodiment of the present invention the horn assembly is replaced or augmented by a light assembly, smoke producing means and/or homing beacon.

In one preferred method of use, when under water, the cap is released from the housing to expose a pull ring. A force is imparted on the pull ring to separate the core from the housing. This causes the release of compressed gas from a canister to inflate the tube and simultaneously allows the circuit connecting the power supply to the horn assembly and/or light assembly to be completed. The pull ring is then released and the core rises to the surface by virtue of the gas in the now inflated tube. When the core reaches the surface it floats in a manner which allows the horn (and/or light, smoke producing means and/or homing beacon) to emit a sound (and/or light, smoke and/or homing signal) easily discernable by persons in the area.

The use of the above-described device and technique substantially improve the likelihood that a diver in trouble will be safely rescued. This is accomplished by virtue of the simple and effective method and apparatus of the present invention for visually and/or audibly indicating the occurrence and location of an underwater emergency.

The use of a shrieking horn in the present invention, akin to that of a rape siren, is indicative of an emergency and would not be ignored by those within earshot. Certainly, the use of such a horn coupled with a visual indication of the presence of a diver (e.g., red and white diagonal striping) would alert other divers not specifically knowledgeable of the function of the present invention, of the presence of a down diver in trouble.

DETAILED DESCRIPTION

Figure 1:
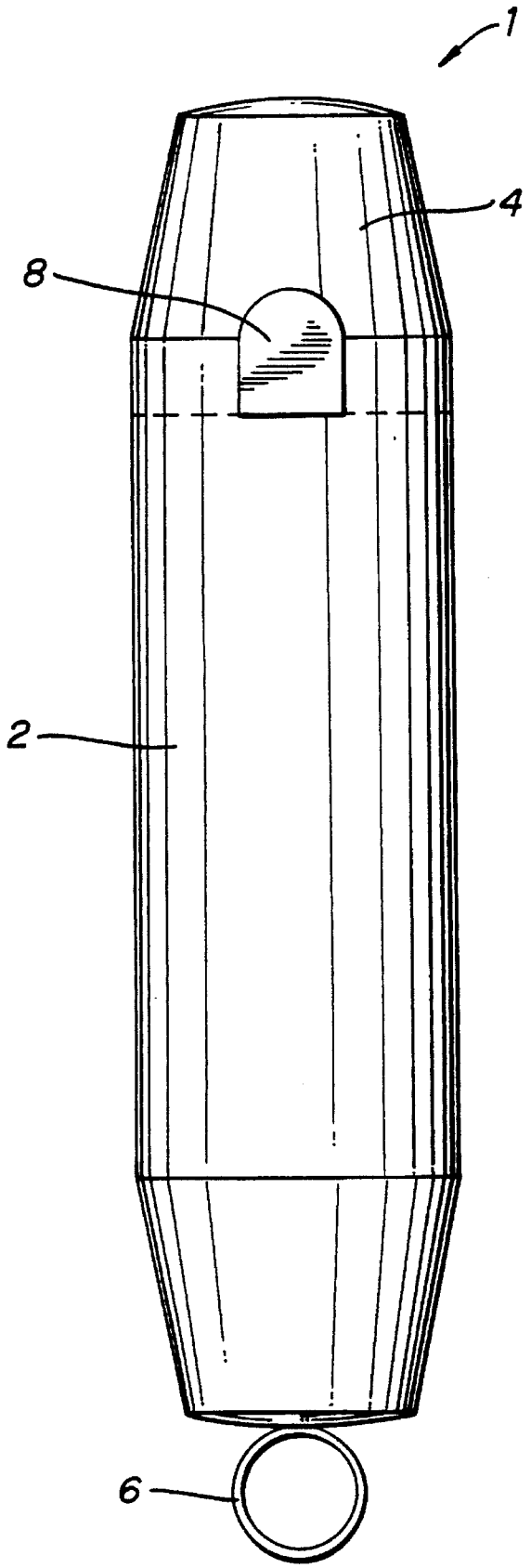
FIG. 1 is a side plan view of one embodiment of the present invention.

Referring to FIG. 1, the device 1 of the present invention comprises an essentially cylindrical housing 2 having a releasably attached cap 4. The cap 4 may be attached to the housing 2 by any number of methods including interlocking threads, one or more hinges, tape or friction. As shown in FIG. 1, in one embodiment of the present invention, the lid is affixed by a single hinge and held in place by a spring biased locking lever 8.

A ring 6 is preferably attached at the distal end of the housing 2 to provide a means to attach the device to a dive belt or the like. However, the device may also be strapped to a diver's leg, much like a diving knife.

Figure 2:
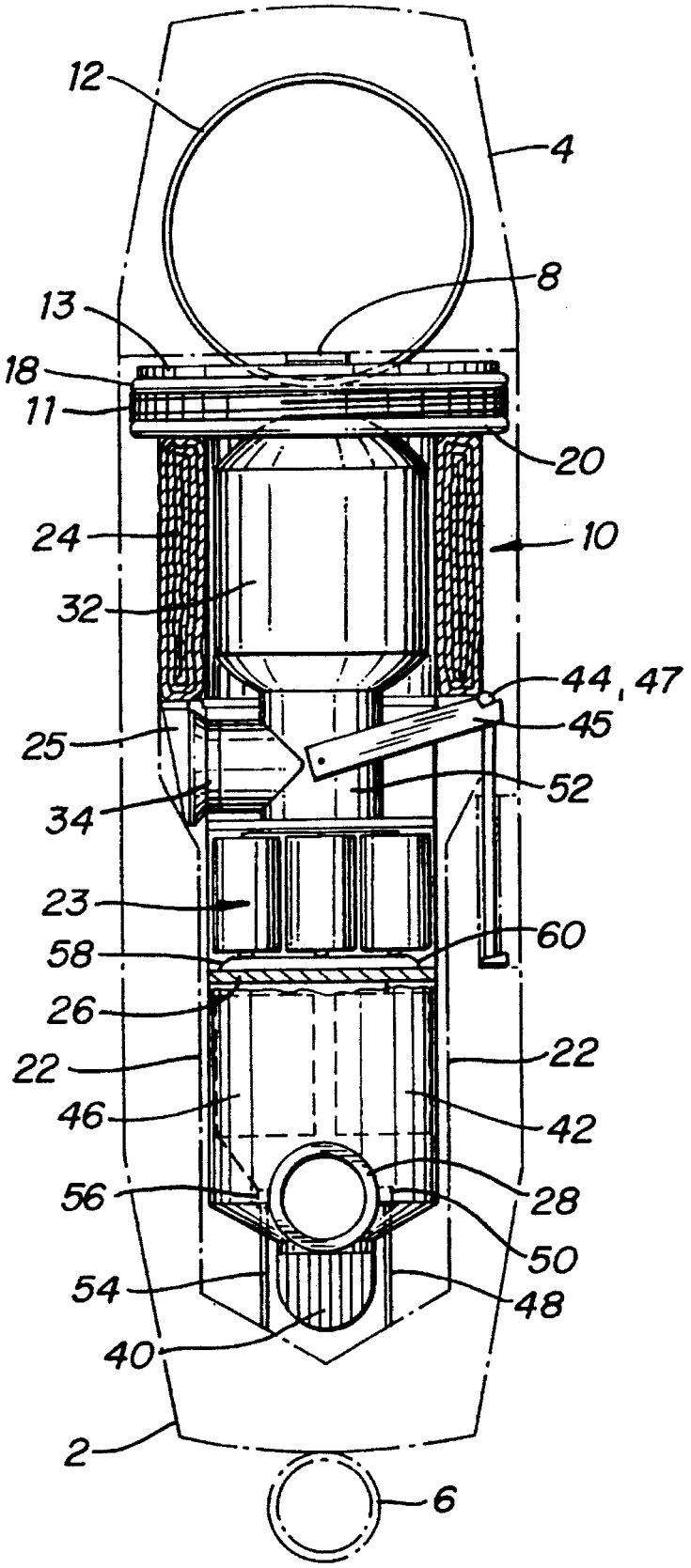
FIG. 2 is a cross-sectional view of one embodiment of the present invention.

Referring to FIG. 2, the housing 2 surrounds a core 10 which comprises the working elements of the present invention. The core 10 is mated to the housing 2, preferably via cooperative threads 11 and is suspended beneath a weighted pull ring 12. The pull ring 12 is attached to a circular disk 13 with grooves which act as seats for a pair of O-rings 18 and 20. These O-rings act to seal the core 10 within the housing 2 and away from the corrosive effects of sea water.

A substantially tubular support 22 extends downwardly from the disk 13 to act as a support for an inflatable tube 24 (on the outside) and a battery pack 23 and associated circuit board 26 (on the inside). The circuit board 26 is connected to the battery pack 23 via connectors 58 and 60 and provides the necessary circuitry to: create the warbling shriek of a horn (siren) 28; turn a light 40 on and off; and/or simply connect the battery pack 23 to a homing device 42. The light (or beacon) 40, horn 28, smoke means 46 and/or homing device 42 also rely on the support 22 for support, albeit indirectly.

A compressed gas cylinder 32 is connected to a one-way valve 34 which communicates with the inflatable tube 24 via a fill tube 25. This allows the inflatable tube 24 to accept and maintain the gas received from the gas cylinder 32.

Figure 3:
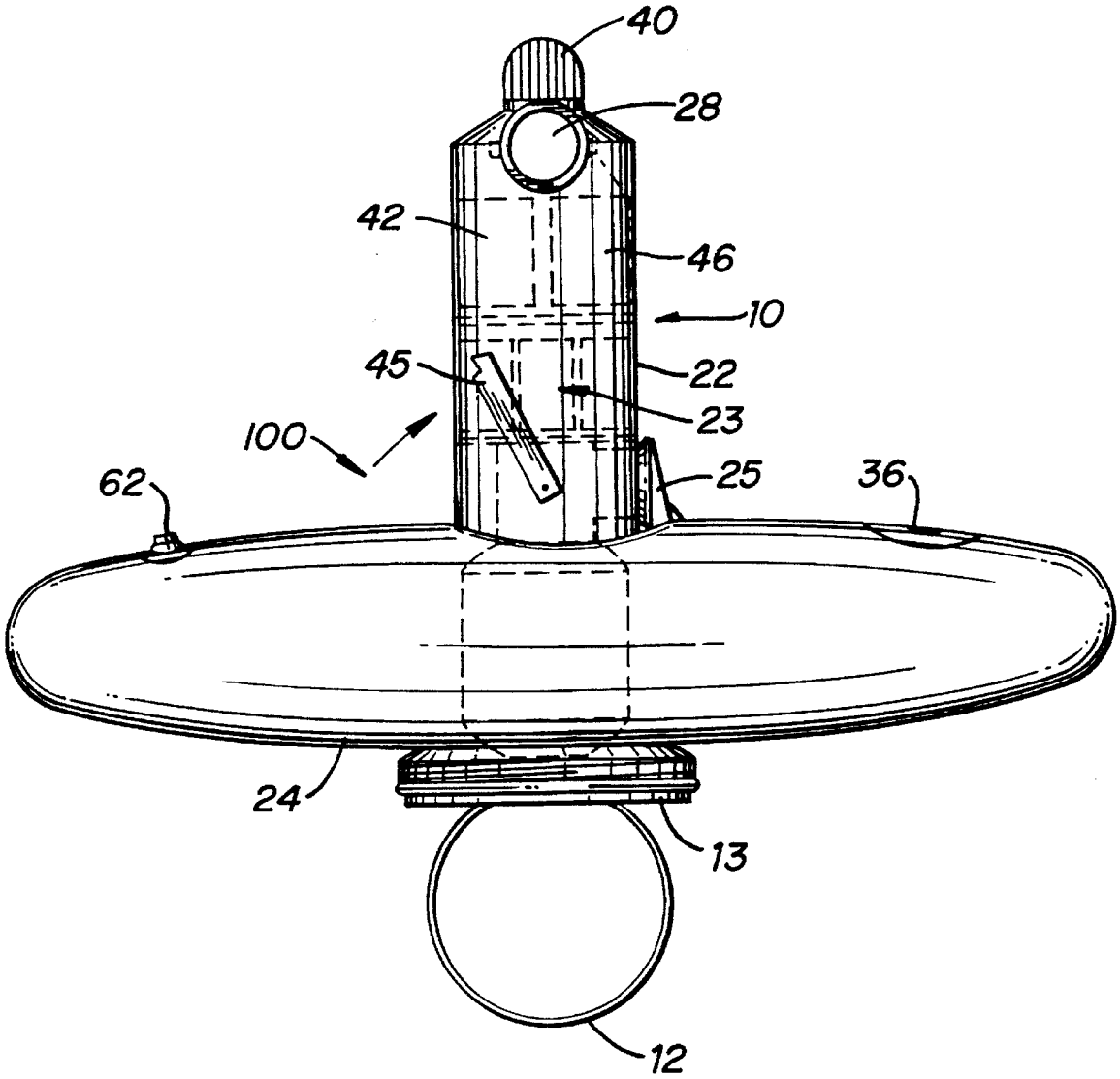
FIG. 3 is a cross-sectional view of the fully expanded condition of one embodiment of the present invention.

Referring to FIG. 3, when the apparatus of the present invention is fully inflated it resembles a donut with the weighted pull ring 12 and gas cylinder 32 at the bottom and the beacon 40 and/or horn 28 extending above the upper surface of the tube 24. The weighted pull ring 12 and gas cylinder 32 serve to orient the device 100 such that the horn 28 and/or light 40 are at the top, extending above the tube 24. A burst valve 36 is preferably provided in the tube 24 to prevent over-inflation from the gas from the cylinder 32.

Figure 4:
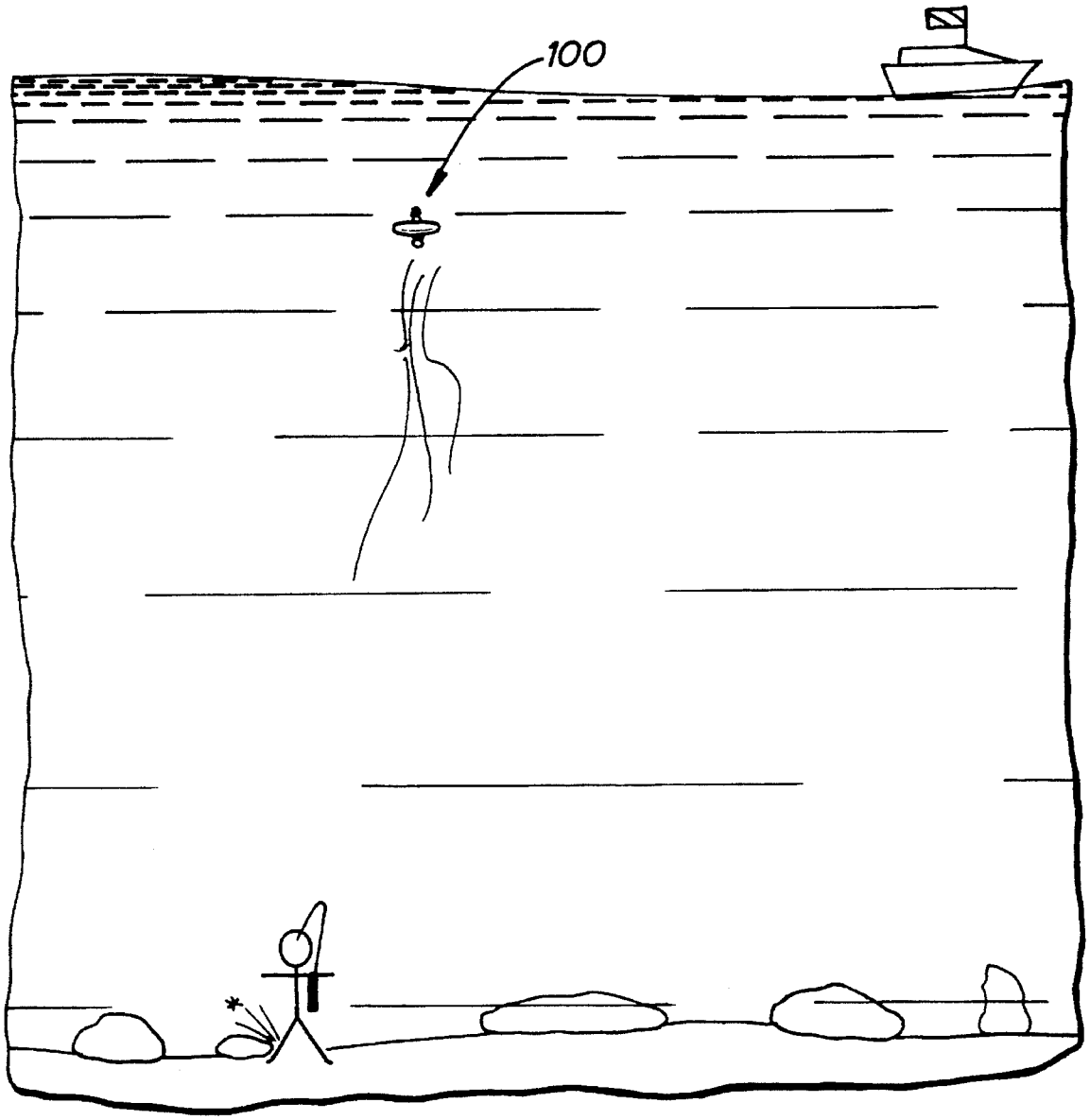
FIG. 4 is a schematic view of the deployment of one embodiment of the present invention.

Referring to FIGS. 2 and 4, the apparatus of the present invention is preferably carried by a diver on his dive belt via engagement of the securing ring 6. The device 1 simply hangs harmlessly at the divers' side when not in use. Since it is preferably, of a size less than 3"×3"×8", it does not interfere with the diver's activities. If the diver finds himself in trouble he first removes the cap 4, which serves to prevent inadvertent activation of the device 7. Then, he imparts a twisting or pulling force upon the pull ring 12 to separate the core 10 from the housing 2 (the twisting or pulling initially vents the area beneath the O-rings to break any vacuum) and "throws" the device up or out from his body. The pulling action automatically completes the circuit between the battery and the horn 28, light 40 and/or beacon 40 by moving pin 48, which is affixed to the housing 2, from between a spring biased switch 50. The pulling action also moves a rocker arm 45 which was previously stabilized by a release shaft 44 connected to the housing 2. A second pin 54, affixed to the housing 2, is attached to a smoke vial release 56. The smoke vial release 56 is attached to a smoke vial which is broken when the core 10 separates from the housing 2. The rocker arm 45, by interacting with a stop 47, causes the piercing of a sealed end 52 of the gas cylinder 32 to start the flow of gas to the tube 24 through the valve 34. Any excess gas is bled off via the burst valve 36.

When the inflation is complete, the core 10, attached to the tube 24, ascends toward the surface away from the housing 2, see FIGS. 3 and 4. If the tube 24 does not inflate at all, or only partially inflates, a manual valve 62 is provided which can be used by a diver to fill the tube with air by using his mouth or his regulator.

When the core 10 with the inflated tube 24 reaches the surface, the horn 28 and/or light 40 and/or homing device 42 and/or smoke signal the distress of the down diver. These systems have been previously activated upon release from the housing and completion of the circuit.

While reference has been made to certain specific components one of skill in the art could alter such components without departing from the spirit or intent of the invention.

I claim:

1. A diver alarm system to be activated under water comprising:

a housing;

a core removably mounted in said housing in a manner which prevents inadvertent removal and sealed in said housing against the ingress of water, wherein said core comprises:

an inflatable tube;

inflation means for automatically inflating said tube when said core is removed from said housing;

horn means; and power supply means for activating said horn mean; and orientation means for properly orienting said system in water without reliance on a tether.

2. An apparatus according to claim 1, further comprising attachment means connected to said housing for attaching said apparatus to a diver's diving equipment.

3. An apparatus according to claim 1, further comprising pull means for removing said core from said housing.

4. An apparatus according to claim 1, wherein said tube is in the shape of a ring.

5. An apparatus according to claim 1, further comprising light means activated by said power means.

6. An apparatus according to claim 1, further comprising smoke means.

7. An apparatus according to claim 1, further comprising a one-way valve operatively connected to said inflation means and a burst valve operatively connected to said tube.

8. An apparatus according to claim 1, further comprising external valve means for manually inflating said tube.

9. An apparatus according to claim 1, wherein said core is sealed in said housing by at least one O-ring.

10. An apparatus according to claim 9, further comprising cap means removably connected to said housing to further protect said apparatus from accidental activation.

11. An apparatus according to claim 1, further comprising a homing beacon activated by said power means.

12. A method of alerting people on a water's surface of a down diver in distress comprising:

removing a core from a water-tight housing under water;

activating automatic inflation means by removal of said core from said housing to inflate a tube; activating automatic signal means connected to but distinct from said tube, under water, to provide on the surface of the water, sensory indication of a diver in distress;

releasing said tube and said signal means, under water, away from a diver's body; properly orienting said tube and said signal means without the use of a tether;

allowing said tube and said signal means to float to the surface of the water; and signaling for help with said signal means.

13. A method according to claim 12 wherein said automatic signal means is activated when said core is separated from said housing.

14. A method according to claim 12 wherein said signal means provides an audible signal.

15. A method according to claim 12 wherein said signal means provides a luminescent signal.

16. A method according to claim 12 wherein said signal means provides a smoke signal.

17. A method according to claim 12 wherein said signal means provides an electronic homing signal.

18. A diver emergency alarm device to be activated under water comprising:

a housing;

attachment means connected to said housing providing means to attach said housing to a diver's diving equipment;

a core, sealed against the ingress of water in said housing by sealing means and selectively separable from said housing in a manner which presents inadvertent separation, comprising:

support means;

an inflatable tube connected to said support means, wherein a burst valve is operatively connected to said tube to prevent over-inflation of said tube;

inflation means for inflating said tube via a one-way valve;

signal means supported by said support members for providing sensory indication of an emergency;

power means for activating at least a portion of said signal means; and orientation means for properly orienting said device such that said signal means is located in the atmosphere above the tube, when the device is on the surface of the water.

19. An apparatus according to claim 18 wherein said signal means generates an audible signal.

20. An apparatus according to claim 18 wherein said signal means generates a luminescent signal.

21. An apparatus according to claim 18 wherein said signal means generates an electronic homing signal.

22. An apparatus according to claim 18 wherein said signal means generates at least two of the following kinds of signals: an audible signal; a smoke signal; a luminescent signal; and/or an electronic homing signal.

23. An apparatus according to claim 18 wherein said signal means generates at least three of the following kinds of signals: an audible signal; a smoke signal; a luminescent signal; and/or an electronic homing signal.

24. An apparatus according to claim 18 wherein said signal means generates the following kinds of signals: an audible signal; a smoke signal; a luminescent signal; and an electronic homing signal.

* * * * *